US011781389B2

(12) United States Patent
Miller et al.

(10) Patent No.: US 11,781,389 B2
(45) Date of Patent: Oct. 10, 2023

(54) SYSTEM, METHOD AND APPARATUS FOR ORIFICE RETENTION AND REPLACEMENT IN A BOTTOM HOLE ASSEMBLY

(71) Applicants: ERDOS MILLER, INC., Houston, TX (US); BLACK DIAMOND OILFIELD RENTALS, LLC, The Woodlands, TX (US)

(72) Inventors: Kenneth C. Miller, Houston, TX (US); David Cramer, Okotoks (CA); Steven Paul Howard, Broussard, LA (US)

(73) Assignees: ERDOS MILLER, INC., Houston, TX (US); BLACK DIAMOND OILFIELD RENTALS, LLC, The Woodlands, TX (US)

( * ) Notice: Subject to any disclaimer, the term of this patent is extended or adjusted under 35 U.S.C. 154(b) by 0 days.

(21) Appl. No.: 18/081,273

(22) Filed: Dec. 14, 2022

(65) Prior Publication Data

US 2023/0193709 A1 Jun. 22, 2023

Related U.S. Application Data

(60) Provisional application No. 63/290,466, filed on Dec. 16, 2021.

(51) Int. Cl.

| | |
|---|---|
| ***E21B 23/00*** | (2006.01) |
| ***E21B 34/08*** | (2006.01) |
| *E21B 47/18* | (2012.01) |

(52) U.S. Cl.

CPC ..... *E21B 23/00* (2013.01); *E21B 34/08* (2013.01); *E21B 47/18* (2013.01)

(58) Field of Classification Search

CPC ..... E21B 47/18; E21B 34/08; E21B 23/00; E21B 47/01; E21B 47/013

See application file for complete search history.

(56) References Cited

U.S. PATENT DOCUMENTS

| | | | | |
|---|---|---|---|---|
| 7,145,834 | B1 * | 12/2006 | Jeter | G01V 11/002 251/129.05 |
| 7,986,245 | B1 * | 7/2011 | Seutter | E21B 47/24 340/854.3 |
| 10,180,060 | B1 * | 1/2019 | Anderson | E21B 47/095 |
| 2005/0173119 | A1 * | 8/2005 | Hay | E21B 36/006 166/57 |
| 2012/0048619 | A1 * | 3/2012 | Seutter | E21B 7/24 175/122 |

* cited by examiner

*Primary Examiner* — Brad Harcourt

(74) *Attorney, Agent, or Firm* — Dickinson Wright PLLC

(57) ABSTRACT

A bottom hole assembly has a tubular component with an axis, a first axial end, a second axial end and a poppet valve assembly mounted in the second axial end. An orifice retainer is mounted inside the tubular component adjacent the first axial end. The orifice retainer has a retainer first axial end, a retainer second axial end opposite the retainer first axial end and an orifice pocket adjacent the retainer second axial end. The orifice retainer is installed in and can be removed from the first axial end of the tubular component, opposite the poppet valve assembly. In addition, an orifice is mounted in the orifice pocket of the orifice retainer. The orifice operates in conjunction with the poppet valve assembly.

20 Claims, 6 Drawing Sheets

SYSTEM, METHOD AND APPARATUS FOR ORIFICE RETENTION AND REPLACEMENT IN A BOTTOM HOLE ASSEMBLY

This application claims priority to and the benefit of U.S. Prov. Pat. App. No. 63/290,466, filed on Dec. 16, 2022, and is incorporated herein by reference in its entirety.

TECHNICAL FIELD

This disclosure relates in general to bottom hole assemblies (BHA) for hydrocarbon wells and, in particular, to a system, method and apparatus for orifice retention and replacement in a BHA.

BACKGROUND

Conventional BHAs for hydrocarbon wells typically have a sub with a muleshoe to support a poppet valve assembly that works in conjunction with an orifice. The poppet valve assembly is used to communicate with surface equipment at the well by transmitting fluid pulses. Over time, the orifice is worn down by fluid flow and needs to be replaced. Such wear diminishes the consistency and clarity of the pulse wave communications. To replace the orifice, the entire assembly must be dismantled at the surface of the well, which can take a substantial amount of time. This is particularly problematic during longer runs when the orifice must be replaced more than once due to wear. Thus, improvements in BHAs continue to be of interest.

SUMMARY

Embodiments of a system, method and apparatus for orifice retention and replacement in a BHA for a hydrocarbon well are disclosed. For example, the BHA can have a tubular component with an axis, a first axial end, a second axial end and a poppet valve assembly mounted in the second axial end. An orifice retainer is mounted inside the tubular component adjacent the first axial end. The orifice retainer has a retainer first axial end, a retainer second axial end opposite the retainer first axial end and an orifice pocket adjacent the retainer second axial end. The orifice retainer is installed in and can be removed from the first axial end of the tubular component, opposite the poppet valve assembly. In addition, an orifice is mounted in the orifice pocket of the orifice retainer. The orifice operates in conjunction with the poppet valve assembly.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

It shall be noted that some of the details and/or features shown in the drawings herein may not be drawn to scale for clarity purposes.

The use of the same reference symbols in different drawings indicates similar or identical items.

DETAILED DESCRIPTION

Figure 1:
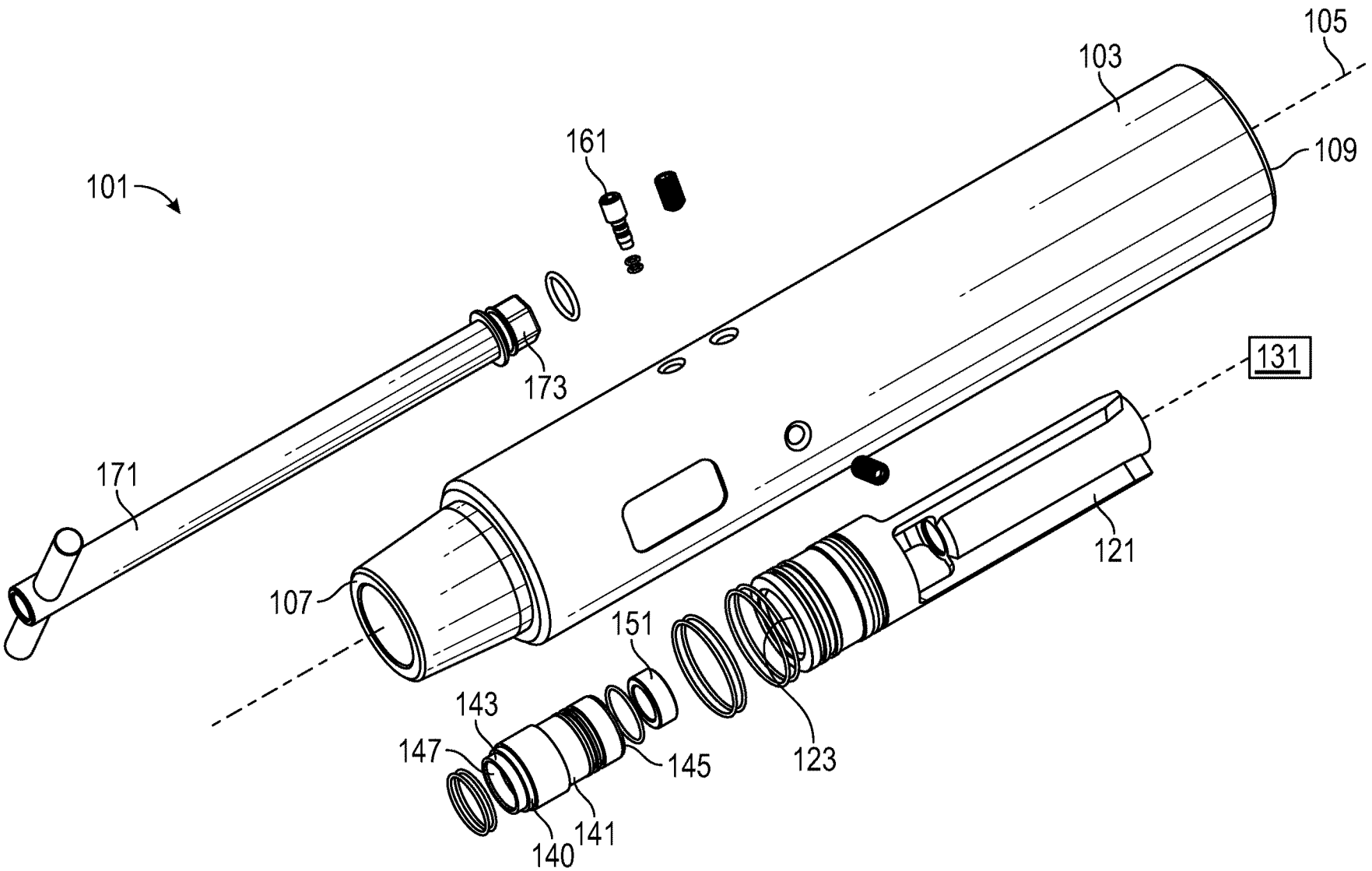
FIG. 1 is an exploded, isometric view of an embodiment of a BHA.
Figure 2:
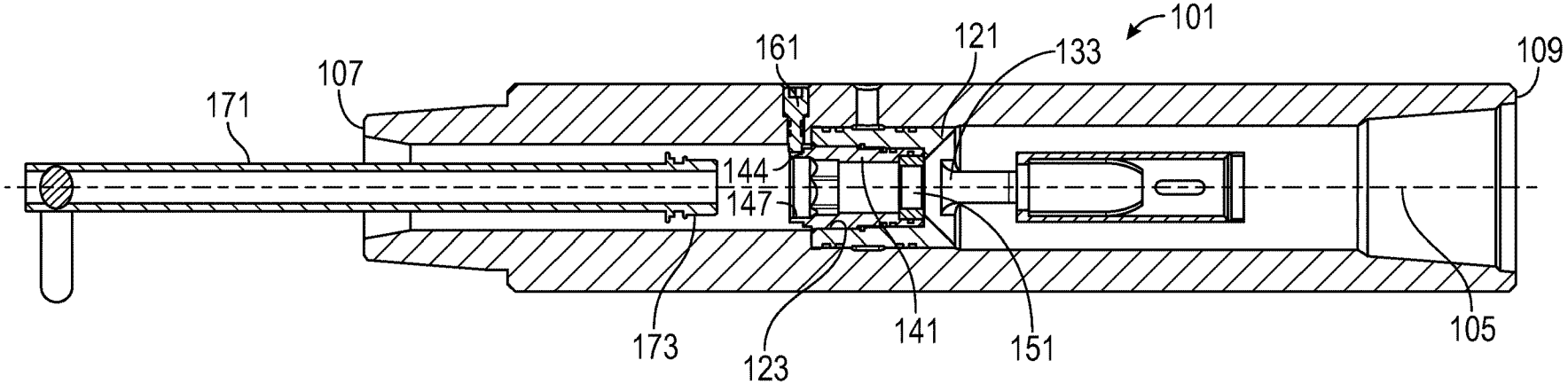
FIG. 2 is a sectional side view of an embodiment of the BHA of FIG. 1 and a tool for it.
Figure 3:
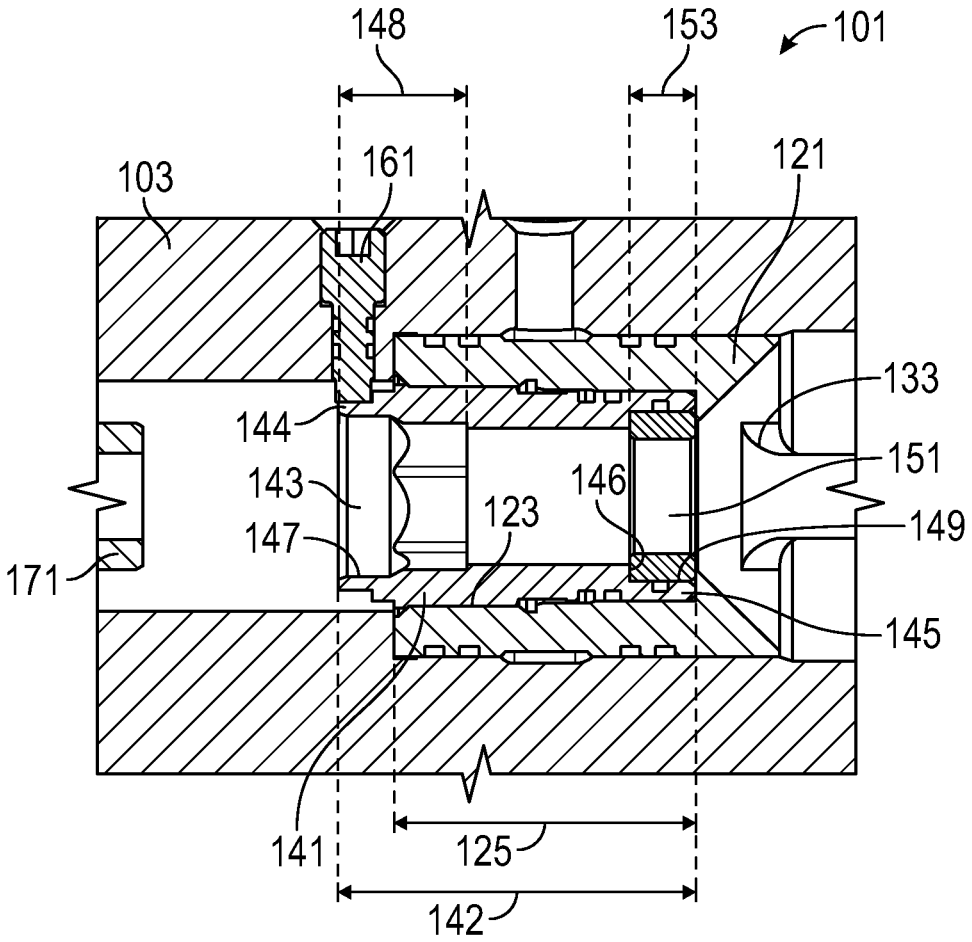
FIG. 3 is an enlarged view of a portion of the embodiment of FIG. 2.

Embodiments of a system, method and apparatus for orifice retention and replacement in a bottom hole assembly (BHA) are disclosed. For example, FIGS. 1-3 depict versions that include an assembly 101, such as for a BHA as is known in the art. The assembly 101 can include a collar or sub 103 having an axis 105, a first sub axial end 107 and a second sub axial end 109. A muleshoe assembly 121, which may be a welded assembly, can be mounted and sealed inside the second sub axial end 109 of the sub 103. A poppet valve assembly 131 (shown schematically) can be mounted to the muleshoe assembly 121. For example, versions of poppet valve assemblies are disclosed in U.S. Pat. Pub. No. US20160208953, which is incorporated herein by reference in its entirety.

Examples of the assembly 101 also can include a cartridge or orifice retainer 141 that can be mounted and sealed inside the muleshoe assembly 121. Examples of the orifice retainer 141 can have a retainer first axial end 143, a retainer second axial end 145 opposite the retainer first axial end 143, and a socket 147 adjacent the retainer first axial end 143. Embodiments of the orifice retainer 141 can be configured to be installed in and removed from, via the socket 147, the muleshoe assembly 121 from the first sub axial end 107.

Embodiments of the assembly 101 can further include an orifice 151. The orifice 151 can be mounted to and sealed inside the muleshoe assembly 121, via the first sub axial end 107 of the sub 103, adjacent to the retainer second axial end 145 of the orifice retainer 141. The orifice 151 can be configured to operate in conjunction with the poppet valve assembly 131, as is known in the art. As shown in FIGS. 2 and 3, the poppet valve assembly 131 can include a poppet 133 that moves axially relative to the orifice 151 to constrict and release fluid flow through the orifice 151. Such movements can be used to send pulse signals to the surface of the hydrocarbon well.

The assembly 101 can include a large or small orifice 151. The orifice 151 can be located inside an orifice pocket 149 (FIG. 3) adjacent to the retainer second axial end 145. The orifice pocket 149 can restrain the orifice 151 from radial movement, and can include a radial seal. In some examples, a set screw or backup bolt 161 can be radially mounted to the sub 103 adjacent the first sub axial end 107 to engage and retain the orifice retainer 141 inside the muleshoe assembly 121.

Versions of the assembly 101 can comprise a tool 171 for installing and removing the orifice retainer 141 in the assembly 101. As an example, the tool 171 can be configured to matingly couple with the socket 147. Embodiments of the tool 171 can include a hexagonal head 173 and the socket 147 can be a hexagonal socket. The orifice retainer 141 can comprise an external thread 140 for engaging an interior thread of the muleshoe assembly 121. Examples of the orifice retainer 141 and orifice 151 can be removable from the first sub axial end 107 without removing the muleshoe assembly 121 and poppet valve assembly 131 from the second sub axial end 109. When the orifice retainer 141 and orifice 151 are removed from the first sub axial end 107, the muleshoe assembly 121 and poppet valve assembly 131 can remain installed in the second sub axial end 109.

Embodiments of the muleshoe assembly 121 can comprise a retainer pocket 123 (FIG. 3) having a pocket axial length 125 that is less than a retainer axial length 142 of the orifice retainer 141. In one example, an end portion 144 of the orifice retainer 141 can extend out of the retainer pocket 123 of the muleshoe assembly 121. Versions of the orifice 151 can have an orifice axial length 153 that is less than half of the pocket axial length 125 of the retainer pocket 123. Examples of the orifice axial length 153 can be less than a socket axial length 148 of the socket 147. In addition, the orifice 151 can be axially located completely inside the orifice retainer 141, and it can abut an axial shoulder 146 inside the orifice retainer 141. Thus, the orifice 151 is axially restrained between the axial shoulder 146 and an axial facing surface (i.e., facing toward orifice retainer 141) inside the muleshoe assembly 121.

Figure 4A:
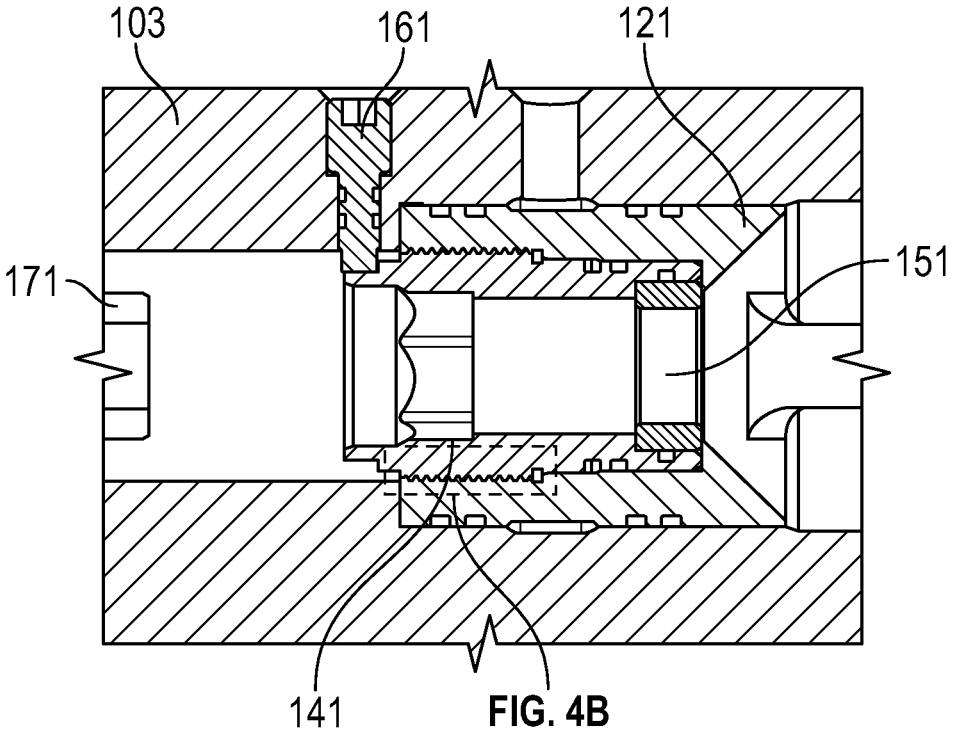
FIG. 4A is a sectional view of another embodiment of a BHA.
Figure 4B:
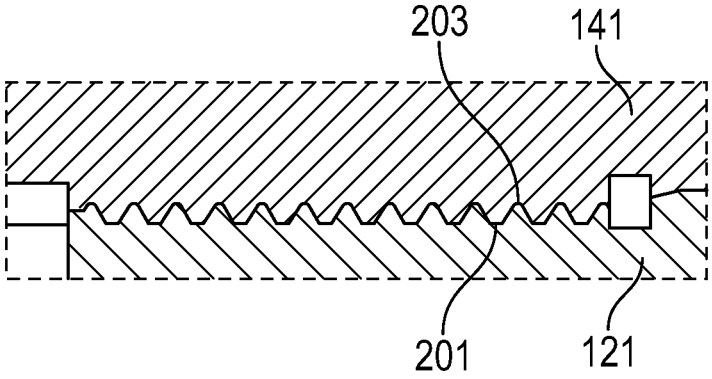
FIG. 4B is an enlarged view of a portion of the embodiment of FIG. 4A.

Alternatively, the orifice retainer 141 can have external threads 201 (FIGS. 4A-B) that couple with internal threads 203 in the muleshoe assembly 121. The orifice retainer 141 can be inserted into the bottom bore of the sub 103 and seated or positioned in the bore of the muleshoe assembly 121. The bore of the lower end of the muleshoe assembly 121 can have internal threads 203. The orifice retainer 141 can have the mating external threads 201. Using the tool 171, the orifice retainer 141 can be threaded into the muleshoe assembly 121. The threads 201, 203 are torqued or tightened. The threads 201, 203 can provide enhanced strength and carry the axial load created by the pressure differential acting on the orifice retainer 141 when fluid passes therethrough during drilling operations. The backup bolt 161 can be used as a secondary mechanism to prevent any rotational movement of the orifice retainer 141 due to vibration downhole while drilling. When it is desired to remove the orifice retainer 141, the backup bolt 161 is removed to allow the orifice retainer 141 to unthread. Using the tool 171, the orifice retainer 141 can be unscrewed or released from the muleshoe assembly 121. The orifice retainer 141 can then be taken out of the bottom of the sub 103 so that the orifice 151 can be replaced.

Figure 5:
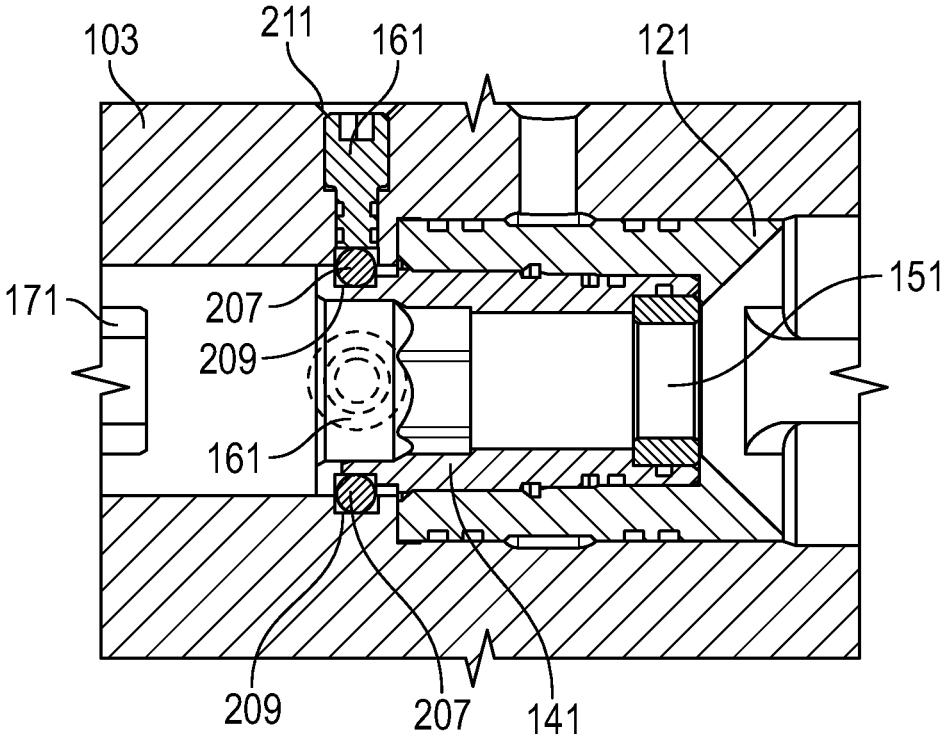
FIG. 5 is a sectional view of still another embodiment of a BHA.

In still another version (FIG. 5), metal retaining balls 207 can be installed in one or more grooves 209 formed between the sub 103 and the orifice retainer 141. Additively, the retaining balls 207 form a strong tensile retention mechanism. The retaining balls 207 can be installed through a port 211 in the sub 103 that can be sealed. The orifice retainer 141 can be inserted into the bottom bore of the sub 103 and seated or positioned in the muleshoe assembly 121. The front of the orifice retainer 141 can have its own ball retaining groove that aligns with a complementary ball retaining groove in the bore of the sub 103. Collectively, the mating grooves 209 can form a retaining groove cavity for the balls 207. The balls 207 can be inserted through the port 211 or another location. The balls 207 can be positioned circumferentially in the mating grooves 209. The balls 207 resting in the mating grooves 209 can provide an enhanced strength mechanism and can carry the axial load created by the pressure differential acting on the orifice retainer 141 when fluid passes through the orifice 151 during drilling operations. When it is desired to remove the orifice retainer 141, the backup bolt 161 can be removed to allow the balls 207 to be removed from the mating grooves 209. Using the tool 171, the orifice retainer 141 can be released from the muleshoe assembly 121 and taken out of the bottom of the sub 103. The balls 207 can be removed with, for example, a flexible push rod from a second hole that is drilled or tapped in the sub 103.

Figure 6A:
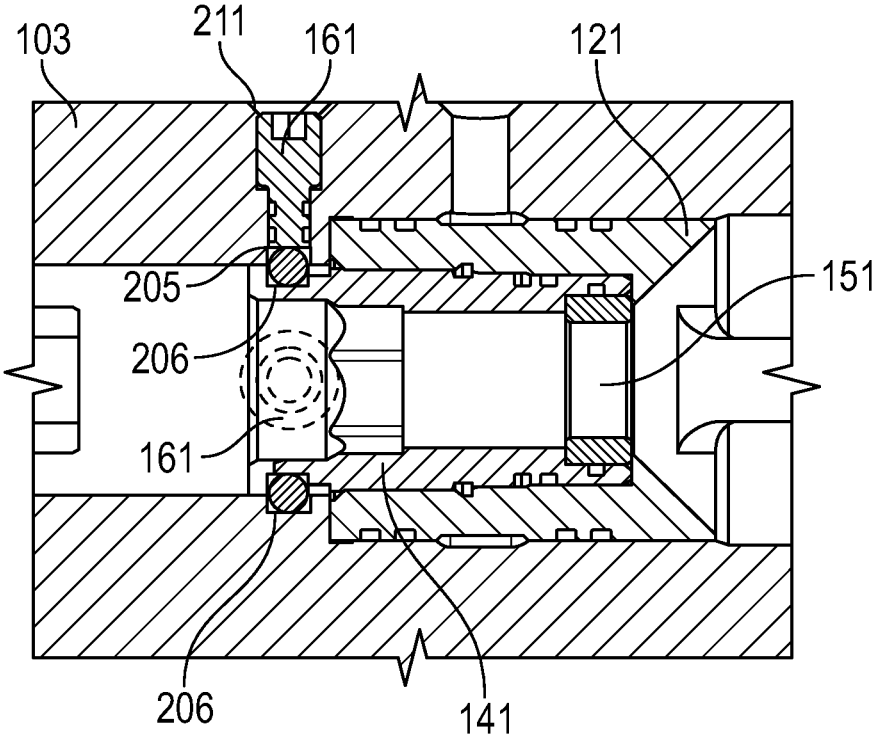
FIG. 6A is a sectional view of yet another embodiment of a BHA.
Figure 6B:
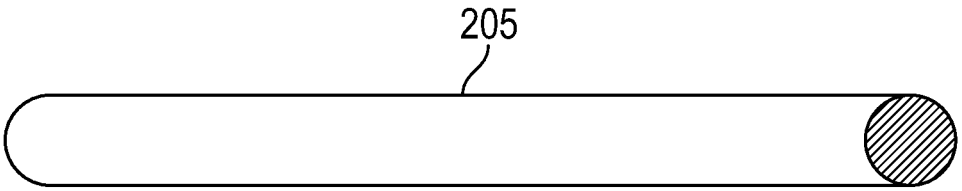
FIG. 6B is an enlarged, partial sectional view of a portion of the embodiment of FIG. 6A.

In yet another example (FIGS. 6A-6B), a metal locking ring 205 can seat in one or more grooves 206 in the muleshoe assembly 121 to secure the orifice retainer 141 in place. The orifice retainer 141 can be inserted into the bottom bore of the sub 103 and seated or positioned in the muleshoe assembly 121. The front of the orifice retainer 141 can have a retaining groove that aligns with a retaining groove in the bore of the sub 103. Collectively, the mating grooves 206 can form a retaining groove cavity for the locking ring 205. The locking ring 205 can be inserted through the port 211 hole where the backup bolt 161 is located. The locking ring 205 can become positioned circumferentially in the mating grooves 206. The locking ring 205 can rest in the mating grooves 206 to provide an enhanced strength mechanism and carry the axial load created by the pressure differential acting on the orifice retainer 141 when fluid passes through the orifice 151 during drilling operations. When it is desired to remove the orifice retainer 141, the backup bolt 161 can be removed to allow the locking ring 205 to be taken out of the mating grooves 206. Using the tool 171, the orifice retainer 141 can be released from the muleshoe assembly 121 and taken out of the bottom of the sub 103. The locking ring 205 can be pushed out using, for example, a flexible push rod through another hole in the sub 103.

Each of these embodiments can work with the backup bolt 161 or a similar mechanism to provide retention of the orifice retainer 141 in the assembly.

Methods of servicing a BHA also are disclosed. For example, the method can include installing a muleshoe assembly inside a sub via a second sub axial end of the sub; mounting a poppet valve assembly to the muleshoe assembly via the second sub axial end of the sub; mounting an orifice inside the muleshoe assembly via a first sub axial end of the sub; and mounting an orifice retainer inside the muleshoe assembly via the first sub axial end, such that the orifice retainer is installed in and can be removed from the muleshoe assembly from the first sub axial end.

Versions of the method can further include radially securing the orifice retainer inside the muleshoe assembly. Some examples of the method can further include installing or removing the orifice retainer in the muleshoe assembly with a tool that matingly couples with the orifice retainer. Still other embodiments of the method can include removing the orifice retainer and orifice from the first sub axial end without removing the muleshoe assembly and poppet valve assembly from the second sub axial end. Additional versions of the method can include removing the orifice retainer and orifice from the first sub axial end while the muleshoe assembly and poppet valve assembly remain installed in the second sub axial end.

The disclosed versions can communicate by transmitting fluid pulses to the surface of the well. When the orifice is worn and needs to be replaced, embodiments do not require the entire assembly to be dismantled at the surface in order to replace the orifice. Rather, the orifice can be quickly replaced without disassembling the upper end (e.g., the muleshoe and poppet valve components). This can be particularly useful in longer runs when the orifice must be replaced more than once due to wear over time. Thus, embodiments can provide more consistent and crisper square wave communications over time than conventional solutions, and decrease downtime when the orifice must be replaced.

Other embodiments can include one or more of the following items.

1. A bottom hole assembly (BHA) for a hydrocarbon well, comprising:
   a sub having an axis, a first sub axial end and a second sub axial end;
   a muleshoe assembly mounted inside the second sub axial end of the sub;
   a poppet valve assembly mounted to the muleshoe assembly;
   an orifice retainer mounted inside the muleshoe assembly adjacent the first sub axial end, the orifice retainer having a retainer first axial end, a retainer second axial end opposite the retainer first axial end, wherein the orifice retainer is configured to be installed in and removed from the muleshoe assembly adjacent the first sub axial end via the socket; and
   an orifice mounted in the retainer second axial end, and the orifice is configured to operate in conjunction with the poppet valve assembly.

2. The BHA further comprising a backup bolt radially mounted to the sub, relative to the axis, adjacent the first sub axial end to engage and retain the orifice retainer inside the muleshoe assembly.

3. The BHA further comprising a tool configured to install and remove the orifice retainer in the muleshoe assembly, wherein the tool is configured to matingly couple with the socket.

4. The BHA wherein the tool comprises a hexagonal head, the socket comprises a hexagonal socket and the orifice retainer comprises an external thread coupled to an internal thread in the muleshoe assembly.

5. The BHA wherein the orifice retainer and the orifice are removable from the first sub axial end without removing the muleshoe assembly and poppet valve assembly from the second sub axial end.

6. The BHA wherein, when the orifice retainer and the orifice are removed from the first sub axial end, the muleshoe assembly and poppet valve assembly remain installed in the second sub axial end.

7. The BHA wherein the muleshoe assembly comprises a retainer pocket having a pocket axial length that is less than a retainer axial length of the orifice retainer.

8. The BHA wherein an end portion of the orifice retainer extends out of the retainer pocket of the muleshoe assembly.

9. The BHA wherein the orifice has an orifice axial length that is less than half of the pocket axial length of the retainer pocket.

10. The BHA wherein the orifice axial length is less than a socket axial length of the socket.

11. The BHA wherein the orifice is axially located completely inside the orifice retainer and abuts an axial shoulder inside the orifice retainer.

12. The BHA further comprising a metal locking ring seated in a groove in the muleshoe assembly to secure the orifice retainer in place, or metal retaining balls installed in a groove formed between the sub and the orifice retainer.

13. The BHA wherein the orifice retainer has a socket adjacent the retainer first axial end, and the orifice retainer is configured to be installed in and removed from the first axial end of the tubular component via the socket.

14. The BHA wherein the orifice retainer is retained in the sub with at least one of:
   a backup bolt;
   threads;
   retention balls; or
   a locking ring.

15. The BHA wherein it is not possible to remove the orifice retainer and the orifice from the second sub axial end.

16. A bottom hole assembly (BHA) for a hydrocarbon well, comprising:
   a sub having an axis, a first sub axial end and a second sub axial end;
   a muleshoe assembly mounted inside the second sub axial end of the sub;
   a poppet valve assembly mounted to the muleshoe assembly;
   an orifice configured to operate in conjunction with the poppet valve assembly; and
   an orifice retainer mounted to the muleshoe assembly to secure the orifice therein, wherein the orifice retainer and orifice are removable from the sub without having to remove the muleshoe assembly and poppet valve assembly from the sub, and when the orifice retainer and orifice are removed from the sub, the muleshoe assembly and poppet valve assembly remain installed in the sub.

17. The BHA wherein it is not possible to remove the orifice retainer and the orifice from the second sub axial end.

18. The BHA wherein the orifice retainer is retained in the sub with at least one of:
   a backup bolt;
   threads;
   retention balls; or
   a locking ring.

19. A bottom hole assembly (BHA) for a hydrocarbon well, comprising:
   a tubular component having an axis, a first axial end, a second axial end and a poppet valve assembly mounted in the second axial end;
   an orifice retainer mounted inside the tubular component adjacent the first axial end, the orifice retainer having a retainer first axial end, a retainer second axial end opposite the retainer first axial end and an orifice pocket adjacent the retainer second axial end, wherein the orifice retainer is installed in and can be removed from the first axial end of the tubular component, opposite the poppet valve assembly; and
   an orifice mounted in the orifice pocket of the orifice retainer, and the orifice is configured to operate in conjunction with the poppet valve assembly.

20. The BHA wherein it is not possible to remove the orifice retainer and the orifice from the second axial end.

21. A method of servicing a bottom hole assembly (BHA), the method comprising:
   (a) providing a tubular assembly having first and second axial ends;
   (b) mounting a poppet valve assembly in the second axial end;
   (c) mounting an orifice inside an orifice retainer; and
   (d) mounting the orifice retainer inside the first axial end to secure the orifice therein, such that the orifice retainer is installed in and can be removed from the tubular assembly from the first axial end.

22. A method of servicing a bottom hole assembly (BHA), the method comprising:
   (a) installing a muleshoe assembly inside a sub via a second sub axial end of the sub;

(b) mounting a poppet valve assembly to the muleshoe assembly via the second sub axial end of the sub;

(c) mounting an orifice inside an orifice retainer; and (d) mounting the orifice retainer inside the muleshoe assembly via the first sub axial end to secure the orifice therein, such that the orifice retainer is installed in and can be removed from the muleshoe assembly from the first sub axial end.

23. The method further comprising radially securing the orifice retainer inside the muleshoe assembly.

24. The method further comprising installing or removing the orifice retainer in the muleshoe assembly with a tool that matingly couples with the orifice retainer.

25. The method further comprising removing the orifice retainer and orifice from the first sub axial end without removing the muleshoe assembly and poppet valve assembly from the second sub axial end.

26. The method further comprising removing the orifice retainer and orifice from the first sub axial end while the muleshoe assembly and poppet valve assembly remain installed in the second sub axial end.

27. A method of servicing a bottom hole assembly (BHA), the method comprising:

(a) mounting a muleshoe assembly inside a sub;

(b) mounting a poppet valve assembly to the muleshoe assembly;

(c) mounting an orifice inside an orifice retainer;

(d) mounting the orifice retainer inside the muleshoe assembly to secure the orifice therein, such that the orifice retainer and orifice are removable from the sub without having to remove the muleshoe assembly and poppet valve assembly from the sub; and (e) removing the orifice retainer and orifice from the sub while the muleshoe assembly and poppet valve assembly remain installed in the sub.

28. The method wherein it is not possible to remove the orifice retainer and the orifice from the second axial end.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom," and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of:

A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A bottom hole assembly (BHA) for a hydrocarbon well, comprising:

a sub having an axis, a first sub axial end and a second sub axial end;

a muleshoe assembly mounted inside the second sub axial end of the sub;

a poppet valve assembly mounted to the muleshoe assembly;

an orifice retainer mounted inside the muleshoe assembly adjacent the first sub axial end, the orifice retainer having a retainer first axial end, a retainer second axial end opposite the retainer first axial end, and a socket adjacent the retainer first axial end, wherein the orifice retainer is configured to be installed in and removed from the muleshoe assembly adjacent the first sub axial end via the socket; and an orifice mounted in the retainer second axial end, and the orifice is configured to operate in conjunction with the poppet valve assembly.

2. The BHA of claim 1, further comprising a backup bolt radially mounted to the sub, relative to the axis, adjacent the first sub axial end to engage and retain the orifice retainer inside the muleshoe assembly.

3. The BHA of claim 1, further comprising a tool configured to install and remove the orifice retainer in the muleshoe assembly, wherein the tool is configured to matingly couple with the socket.

4. The BHA of claim 3, wherein the tool comprises a hexagonal head, the socket comprises a hexagonal socket and the orifice retainer comprises an external thread coupled to an internal thread in the muleshoe assembly.

5. The BHA of claim 1, wherein the orifice retainer and the orifice are removable from the first sub axial end without removing the muleshoe assembly and poppet valve assembly from the second sub axial end.

6. The BHA of claim 1 wherein, when the orifice retainer and the orifice are removed from the first sub axial end, the muleshoe assembly and poppet valve assembly remain installed in the second sub axial end.

7. The BHA of claim 1, wherein the muleshoe assembly comprises a retainer pocket having a pocket axial length that is less than a retainer axial length of the orifice retainer.

8. The BHA of claim 7, wherein an end portion of the orifice retainer extends out of the retainer pocket of the muleshoe assembly.

9. The BHA of claim 7, wherein the orifice has an orifice axial length that is less than half of the pocket axial length of the retainer pocket.

10. The BHA of claim 9, wherein the orifice axial length is less than a socket axial length of the socket.

11. The BHA of claim 1, wherein the orifice is axially located completely inside the orifice retainer and abuts an axial shoulder inside the orifice retainer.

12. The BHA of claim 1, further comprising a metal locking ring seated in a groove in the muleshoe assembly to secure the orifice retainer in place, or metal retaining balls installed in a groove formed between the sub and the orifice retainer.

13. The BHA of claim 1, wherein the orifice retainer is retained in the sub with at least one of:

a backup bolt;

threads;

retention balls; or a locking ring.

14. The BHA of claim 1 wherein it is not possible to remove the orifice retainer and the orifice from the second sub axial end.

15. A bottom hole assembly (BHA) for a hydrocarbon well, comprising:

a sub having an axis, a first sub axial end and a second sub axial end;

a muleshoe assembly mounted inside the second sub axial end of the sub;

a poppet valve assembly mounted to the muleshoe assembly;

an orifice configured to operate in conjunction with the poppet valve assembly; and an orifice retainer mounted inside the muleshoe assembly opposite to the poppet valve assembly to secure the orifice therein, wherein the orifice retainer and orifice are removable from the sub without having to remove the muleshoe assembly and poppet valve assembly from the sub, and when the orifice retainer and orifice are removed from the sub, the muleshoe assembly and poppet valve assembly remain installed in the sub.

16. The BHA of claim 15 wherein it is not possible to remove the orifice retainer and the orifice from the second sub axial end.

17. The BHA of claim 15, wherein the orifice retainer is retained in the sub with at least one of:

a backup bolt;

threads;

retention balls; or a locking ring.

18. A bottom hole assembly (BHA) for a hydrocarbon well, comprising:

a tubular component having an axis, a first axial end, a second axial end;

a poppet valve assembly mounted in the second axial end of the tubular component;

an orifice retainer removably mounted inside the first axial end of the tubular component, opposite the poppet valve assembly, the orifice retainer having a retainer first axial end, a retainer second axial end opposite the retainer first axial end, and an orifice pocket adjacent the retainer second axial end, wherein the orifice retainer is installed in and can be removed from the first axial end of the tubular component; and an orifice mounted in the orifice pocket of the orifice retainer, and the orifice is configured to operate in conjunction with the poppet valve assembly.

19. The BHA of claim 18 wherein it is not possible to remove the orifice retainer and the orifice from the second axial end.

20. The BHA of claim 18, wherein the orifice retainer has a socket adjacent the retainer first axial end, and the orifice retainer is configured to be installed in and removed from the first axial end of the tubular component via the socket.

* * * * *